US008235620B2

(12) United States Patent
Fisher

(10) Patent No.: US 8,235,620 B2
(45) Date of Patent: Aug. 7, 2012

(54) FLUID APPLICATOR

(76) Inventor: Martin Fisher, Isle of Wight (GB)

( * ) Notice: Subject to any disclaimer, the term of this patent is extended or adjusted under 35 U.S.C. 154(b) by 1114 days.

(21) Appl. No.: 11/996,317

(22) PCT Filed: Jul. 21, 2006

(86) PCT No.: PCT/GB2006/002739

§ 371 (c)(1),
(2), (4) Date: May 20, 2008

(87) PCT Pub. No.: WO2007/010279

PCT Pub. Date: Jan. 25, 2007

(65) Prior Publication Data

US 2008/0226382 A1 Sep. 18, 2008

(30) Foreign Application Priority Data

Jul. 21, 2005 (GB) ..... 0514941.4

(51) Int. Cl.
*B43M 11/02* (2006.01)

(52) U.S. Cl. ..... 401/220; 401/219; 15/230.11

(58) Field of Classification Search ..... 401/208, 401/218, 219, 220, 171, 176, 177, 179, 181, 401/182, 137; 15/230.11
See application file for complete search history.

(56) References Cited

U.S. PATENT DOCUMENTS

| | | | |
|---|---|---|---|
| 2,824,326 | A | 2/1958 | Ames |
| 3,115,659 | A | 12/1963 | Church |
| 3,128,494 | A | 4/1964 | Hohmann |
| 3,622,246 | A | 11/1971 | Grooms |
| 4,566,816 | A | 1/1986 | Janssen |
| 5,095,575 | A | 3/1992 | Jarecki et al. |

FOREIGN PATENT DOCUMENTS

| | | |
|---|---|---|
| AT | 392742 | 5/1991 |
| CH | 83736 | 6/1920 |
| DE | 9315499 | 12/1993 |
| EP | 1070548 | 1/2001 |
| GB | 1349173 | 3/1974 |
| GB | 2258292 | 2/1993 |
| WO | 03101623 | 12/2003 |

*Primary Examiner* — David Walczak
(74) *Attorney, Agent, or Firm* — Chernoff, Vilhauer, McClung & Stenzel, LLP

(57) ABSTRACT

Applicators for fluids such as paints utilizing a roller are known and more recently utilization of an incrementally displaceable piston in order to force fluid flow to a roller has been disclosed. In order to ensure appropriate presentation of the fluid, that is to say paint, to the roller an appropriate gap between the roller and the housing is required. By position of a cam and/or flap control of a housing to roller gap is achieved.

8 Claims, 12 Drawing Sheets

FLUID APPLICATOR

This is a national stage application filed under 35 USC 371 based on International Application No. PCT/GB2006/002739 filed Jul. 21, 2006, and claims priority under 35 USC 119 of United Kingdom Patent Application No. 0514941.4 filed Jul. 21, 2005.

The present invention relates to fluid applicators and more particularly to a roller fluid applicators used with regard to applying paint or a similar coating to a surface.

It is known to utilise rollers with a foam or a fleece covering in order to apply paint to a surface. Traditionally, these rollers have been dipped in a tray of paint and excess removed upon a washboard. It is also known to provide powered systems utilising compressed air in order to force paint onto a roller for more commercial and large scale application on paint surfaces normally by professional decorators. More recently International Patent Application No. PCT/GB03/002304 has described use of a piston within a reservoir in order to achieve relatively low forced flow of paint towards a roller through ratchet stepped advancement. In such circumstances the low iterative loading capacity of a simple roller is avoided by the forced flow of paint towards the roller but avoiding the significant costs and complexity of using relatively high pressure compressed air or pumping mechanisms. It will be understand that compressed air systems have sufficient force to ensure that paint is presented to the roller through the roller surface itself for even distribution. A lower pressure is achievable through a simple ratchet piston forcing presentation of the paint to the roller through a slot and gap in a housing for the roller. In such circumstances it is important that an appropriate gap is maintained between the roller and the slot so that paint can pass as appropriate but the gap is not so large that paint is simply spurted out. Furthermore, on the other side of the slot a paint trap is generally provided in order to further control and regulate paint flow onto the roller.

As indicated above applicators may be used for a number of fluids including paints. It is understood that these fluids may have different and variable viscosities but as a simple gap between the roller and the slot is generally used to control the low level fluid pressure created by pumping through a ratchet mechanism there may be problems as a result of this variability. It will be understood that the fluids applied may be relatively thin emulsion paint or thicker oil based paints and potentially adhesives and sealants to be applied to a surface for rendering. An appropriate fluid applicator should be able to accommodate this range of fluids.

In accordance with a first aspect of the present invention there is provided an applicator for fluids, the applicator comprising a roller within a housing with a gap between the roller and a flap part of the housing to regulate in use fluid flow, the flap displaceable relative to the roller to vary the gap.

Preferably, the flap is secured to the housing through a pivot mounting.

Typically, the flap is displaceable on a screw thread.

Generally, the flap incorporates a trap cavity to one side of the gap. Normally the flap is positioned above the trap cavity.

Generally, the flap extends beyond the end edges of the roller.

Typically, the flap is curved.

Possibly, the flap is associated with a foam seal.

In accordance with a second aspect of the present invention there is provided an applicator for fluids, the applicator comprising a roller within a housing with a gap between them defined by an offset axis of rotation for a spindle of the roller provided by an offset cam on an end of said spindle exposed relative to the housing, the end having an orientation retainer positioned on the end to define presentation of the spindle on the cam offset.

Typically, the orientation retainer comprises a flat chamfer end.

Possibly, the orientation retainer comprises a straight slot in the end. Advantageously, the slot is arranged to accept a tool to cause rotation of the end.

Typically, the housing has an offset mark to define the offset cam positions through reference to the orientation retainer on the end. Generally, the gap is defined by alignment between the offset mark and the orientation marker to cause the gap to have a desired value. Possibly, the housing incorporates a plurality of offset marks for different values of the gap.

Normally, the end is secured in a slot of the housing.

Possibly, the end is chamfered to one side to allow the end to enter the slot and the end has a slightly larger diameter than the slot to cause an interference fit for retension of rotation. Advantageously, the slot and end have an entrant engagement. Typically, the entrant engagement is a dovetail.

Typically, the end is integrally formed with the offset cam to define a mounting to accept the spindle.

Further according to the present invention there is provided a method of setting a gap between a roller and a housing in a fluid applicator with an offset cam for a spindle of the roller to define an offset axis of rotation, the method comprising:— a) placing an orientation marker upon an end of the spindle;
b) positioning the spindle at a known orientation using the orientation marker on the end of the spindle.
c) rotating the spindle using the end to cause displacement of the offset axis of rotation in the end of the spindle and so the gap between the roller and the housing when the roller is rotated upon the spindle.

Typically, the orientation marker is aligned with a known part of the housing so that the gap is of a desired value.

Embodiments of the present invention will now be described by way of example only and with reference to the accompanying drawings in which:—

Figure 1:
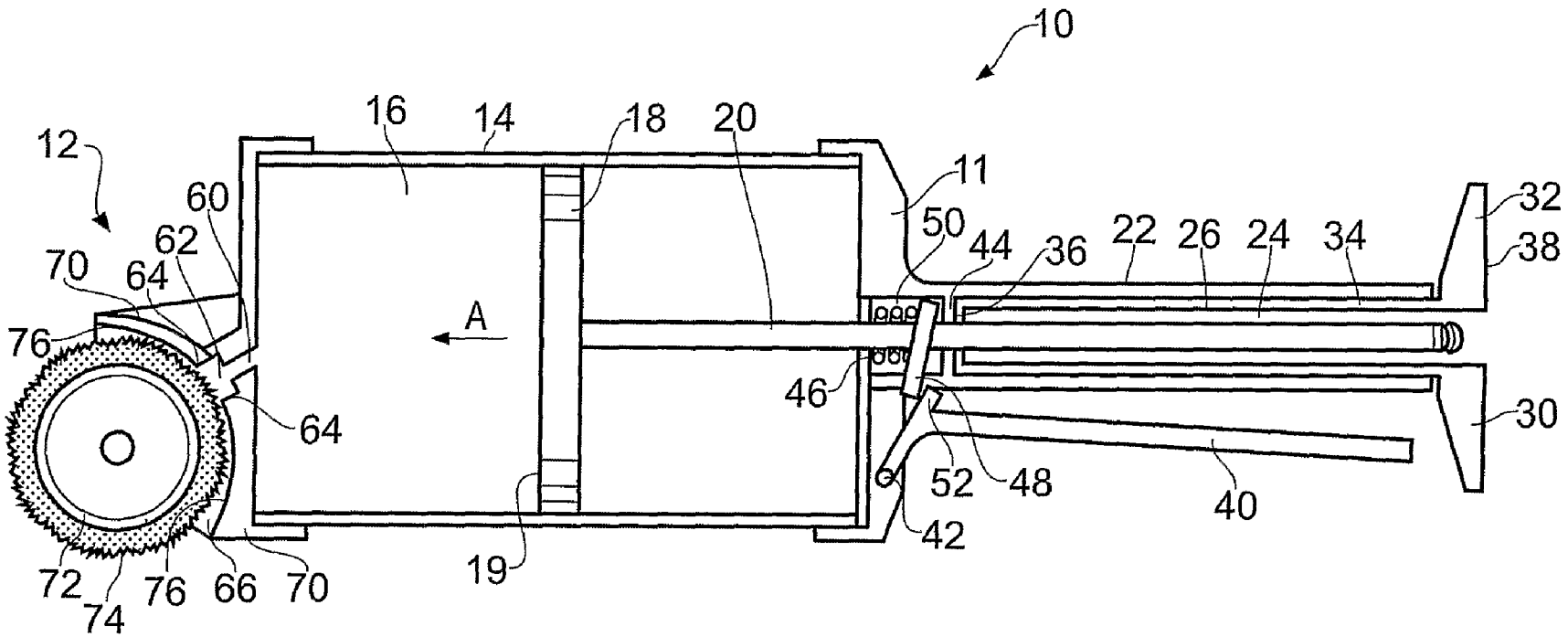
FIG. 1 is a schematic illustration of a typical fluid applicator in which the present invention is incorporated.

FIG. 1 illustrates a typical fluid applicator for applying such fluids as liquids, adhesives and sealants to surfaces. This fluid applicator is described in International Patent Application No. PCT/GB03/002304. As can be seen the applicator 10 includes a roller 72 in a housing 70. Along with a fluid reservoir 14 with a piston 18 forcing a fluid 16 through engagement upon a surface 19 of the piston 18. The reservoir 14 is generally elongate shaped with a reciprocally shaped piston 18 such that the surface 19 moves in the direction of arrow A to force fluid through a slot 60 into a gutter 62 for distribution upon the foam or bristles 74 of the roller 72.

Operation of the applicator 10 is described in International Patent Application No. PCT/GB03/002304 but generally a ram rod 20 is moved forward through a ratchet mechanism comprising a latch 48 and an actuator 40 with a pivot 42 and nudge bar 52 moving the rod 20 forwards in the direction of arrow head A. The mechanism is generally in the form of a handle 22 with a retainer arrangement 44 acting to retain stepped ratchet movements of the rod 20 to create pressure within the fluid 16 and therefore forced flow through the slot 60. There is generally a spring 46 to ensure retained engagement of the ratchet 48 against the rod 20 and retainer 44. Typically the rod includes a screw thread coupling 26 to which extension rods can be added to allow use of the applicator at elevated positions. This is located within a sleeve 34 and in a central cavity 24 to allow displacement along its length. The sleeve 34 includes splayed ends 30, 32 for retention of the sleeve 34 within the handle 22. An end surface 38 allows a user to use percussive force in order to initially create a necessary engagement in the applicator between the surface 19 and the paint. The ratchet advancement mechanism is secured to the reservoir 14 with an end in order to create a sealed enclosure for the fluid and direct flow to the slot 60.

As indicated above the applicator 10 as depicted in FIG. 1 provides a modest forced flow of the fluid 16 through the slot 60. It will be understood that there are applicator arrangements which simply comprise a roller secured to a handle with the roller dipped into a fluid to become loaded. At the other end of the scale there are complicated compressed air and mechanical pump forced flow applicators. The use of a stepped ratchet movement of the piston 18 provides a modest force flow with a simple mechanism and therefore achieves most of the benefits of forced flow with complicated and professional fluid applicator arrangements in a more economic manner suitable for the do it yourself DIY enthusiast.

In view of the reduced pressure created by the ratchet advancement in the applicator 10 depicted in FIG. 1 it is necessary to ensure that a gap between the roller 72 and in particularly the foam 74 covering is accurately controlled. It is understood with more powerful compressed air and mechanical pumping mechanisms which are generally continuous very small gaps can be achieved with the forcing power pushing fluid through onto the roller. With a ratchet stepped advancement applicator 10 that fluid forcing is not sufficient and too narrow a gap will result in insufficient paint being presented to the roller whilst clearly too wide a gap will provide little restraint upon straight through fluid flow under the influence of the forcing pressure with fluids therefore spitting and spilling.

Figure 3:
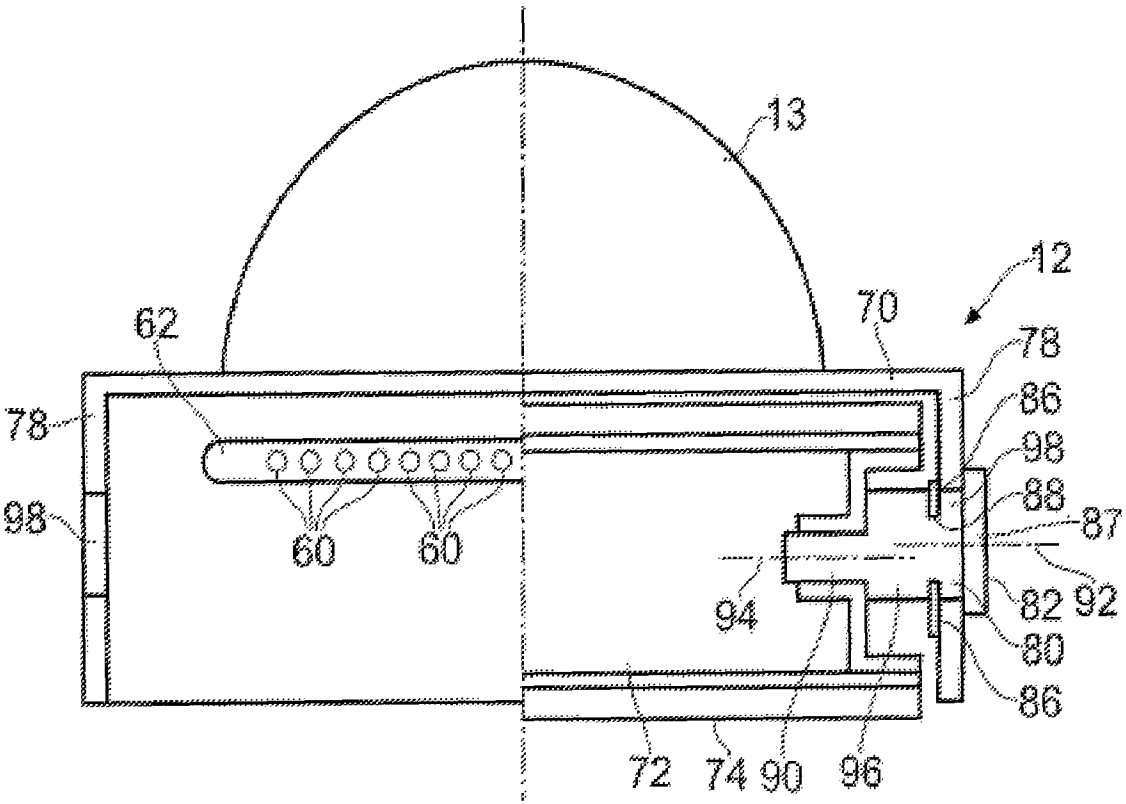
FIG. 3 is a cross section illustrating association between a roller and a housing in a typical prior fluid applicator.
Figure 2:
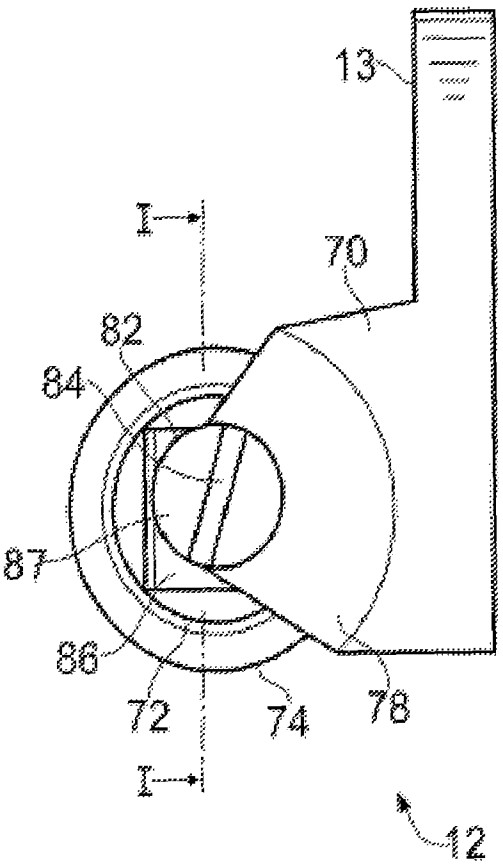
FIG. 2 is a schematic side view of a roller in a housing used in the applicator depicted in FIG. 1.

FIGS. 2 and 3 respectively illustrate fluid applicator heads used in an applicator 10 as depicted in FIG. 1. FIG. 2 illustrates the roller 72 and foam covering 74 secured in the housing 70 upon an end combination comprising an offset cam 82 and end 87. As can been see the housing 70 includes a hood 78 which in turn includes a slot in which the end assembly 86, 87 is secured. By turning the end 87 the offset cam 82 can be adjusted so that the axis of rotation for the roller 72 is rendered off centre. In such circumstances with the head 12 secured to the reservoir 14 the gap created between the covering 74 and opposed surfaces of the housing can be adjusted so that there is a greater gap to one side of the groove 62 in comparison with the other. This adjustment allows accurate control of the gap as indicated between the undesirable situations of too narrow a gap for limited paint distributed and too wide a gap for unacceptably unrestrained fluid flow causing fluid spillage and spitting.

Figure 4:
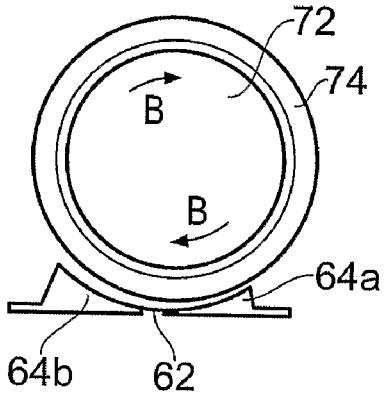
FIG. 4 is a side view illustrating application of the first aspect of the present invention and a second aspect of the present invention.

FIG. 4 illustrates the head depicted in FIG. 2 in a cross section I-I. Thus, as can be seen the reservoir 14 is secured to the head 12 such that the slots 60 which may be a single slot or a number of holes as depicted in FIG. 3 extend into a groove or gutter 62. The roller 72 is secured on a spindle or spindle ends 90 with an end retainer mechanism as described above including a cam offset 82 and end 87. The housing 70 has a hood 78 with sides which include a respective slot as described previously in which the end 87 is secured such that the offset cam 82 moves the axis of rotation 94 for the roller 72 as required. It will be understood that the normal axis of rotation for a perfectly symmetrical retainer in the slot would be as depicted by line 94 in FIG. 3. However, by providing an offset cam 82 it will be understood that rotation of the end 87 moves the actual axis of rotation 92 to an off centre position and thereby displaces the peripheral surface of the covering 74 relative to the groove 62 and slot 60. In such circumstances this arrangement as disclosed in International patent application no. PCT/GB03/002304 allows accurate control of the gap necessary where the forced fluid flow is of a more marginal strength.

For illustrational purposes a schematic cross section through the roller to housing head is depicted in FIG. 4. Thus as can be seen the roller covering 74 has a gap between its outer periphery adjacent to the fluid distribution groove 64 on one side 64(*a*) narrower than on the other side 64(*b*). This is achieved as described above through an offset cam and off centre rotation for the roller 72 in the housing slot as described above. It is the slot in the direction of rotation side 64(*b*) that is generally wider in order that fluid is picked up on rotation in the rotational direction depicted by arrow head B. It will be understood that the forced pressure plus the pick up by rotation of the roller 72 causes distribution of the fluid such as paint on the covering 74. When not in use the forcing pressure is released by releasing the ratchet and therefore conventional surface tension between the fluid and the gaps either side of the groove 62 act to prevent loss of fluid.

It will be understood that the fluid which the applicator applies may vary in terms of its viscosity at ambient temperatures. Fluid viscosity will alter the desirable gap between the roller and the housing for operation in accordance with an applicator described above. Below are described two approaches to provide regulation of the gap to accommodate different fluid viscosities and for wear of the roller or housing.

Figure 6:
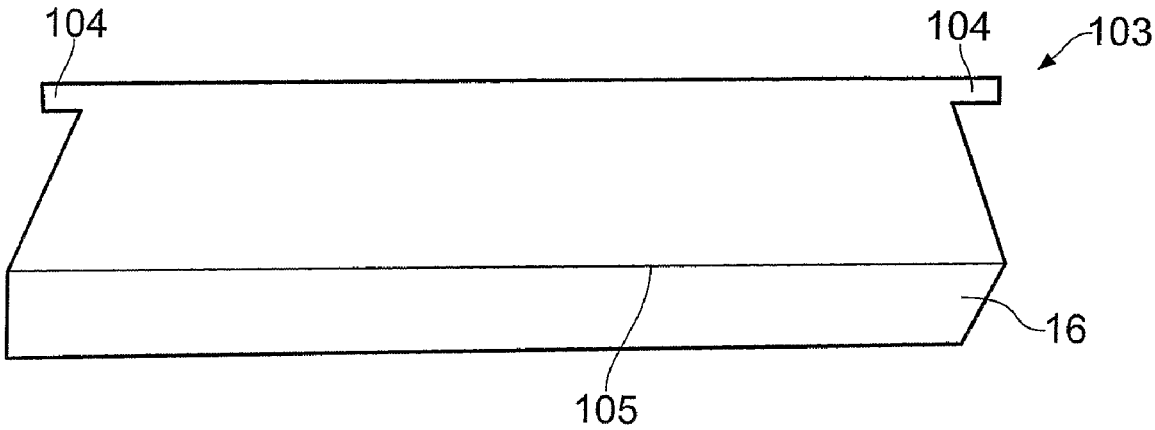
FIG. 6 is a schematic front view of a flap utilised in accordance with the first aspect of the present invention depicted ion FIG. 4.
Figure 7:
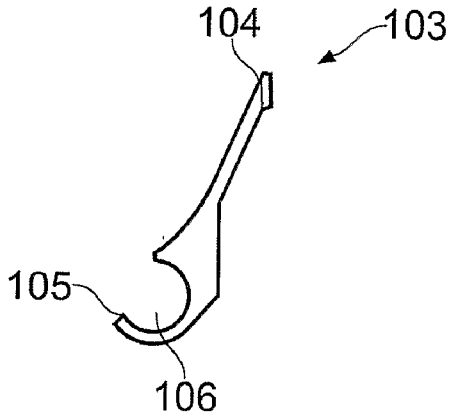
FIG. 7 is a cross sectional view of the flap depicted in FIG. 5.
Figure 5:
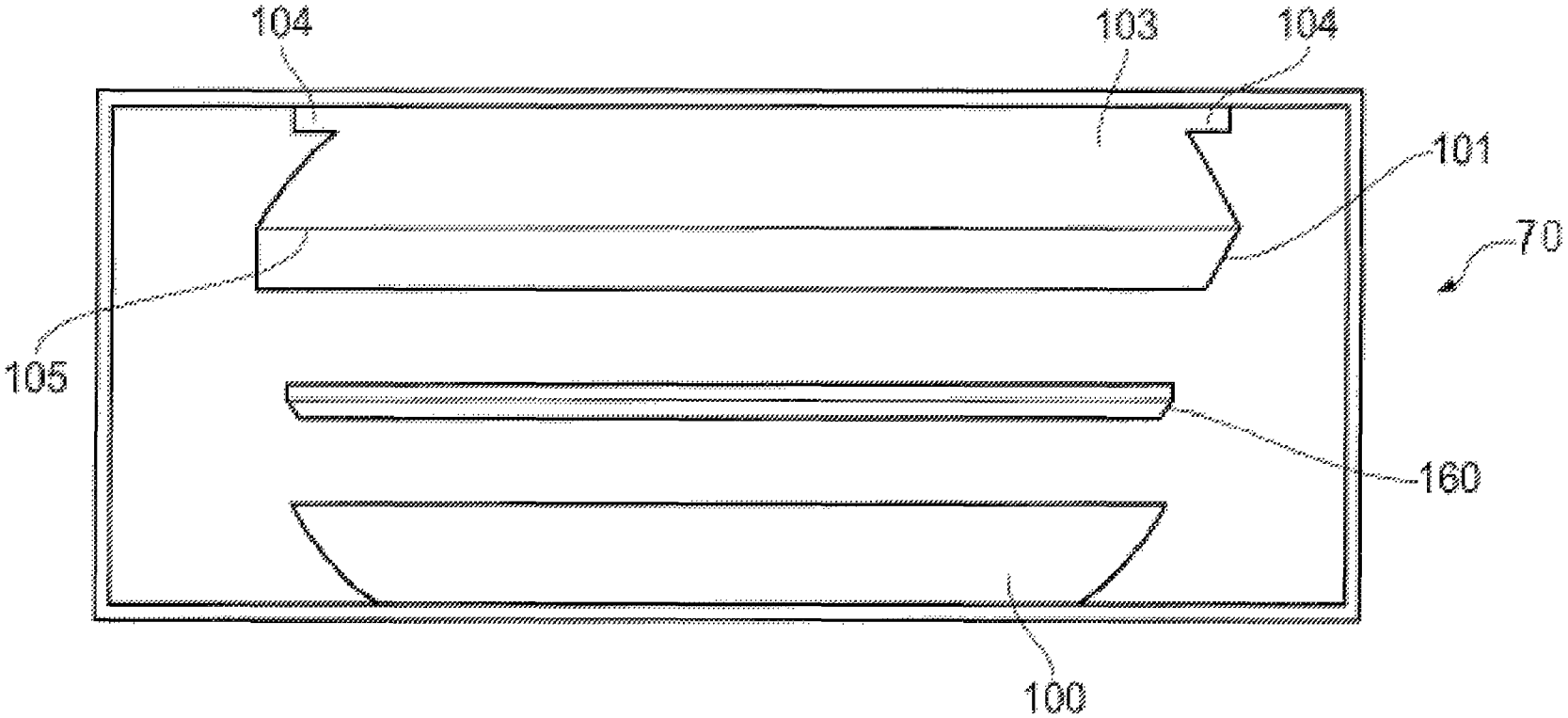
FIG. 5 is a schematic plan view of a housing utilised in a fluid applicator in accordance with a first aspect of the present invention.

FIGS. 5-7 illustrate one approach to vary roller housing gap for fluid regulation. In this first approach or aspect of the present invention a movable flap or housing surface is used in order to alter the gap between the roller and the housing surface. The flap is secured upon a displacement mechanism to adjust the point at which the edge in a similar fashion to that described with regard to edge 64 in FIG. 1 acts to regulate the gap width between the roller and that edge.

FIG. 5 is a schematic plan view of a housing 70 with a roller removed. Thus, the housing 70 has a groove 160 through which a fluid is presented to a roller (not shown). Generally as with previous systems fluid traps 100, 101 are provided either side of the groove 160. These traps 100, 101 act as wells in which access fluid can be retained rather than directly forced out as spillage due to the forcing of the fluid by the ratchet advanced piston in the reservoir as described above. In accordance with this first aspect of the present invention a flap 103 is secured in the fluid trap 101 with a pivot mounting 104 at each end. Thus, a front edge 105 of the flap 103 can be displaced within the housing 70 to alter the gap between that edge 105 as the operative part of the housing and a roller (not shown) when installed within the housing 70. Such an approach allows for variations between differing fluid types, viscosities and other factors. Thus, for example if an adhesive sealant were to be applied to seal a surface then a wider gap may be provided than for more fluid paints.

FIGS. 6 and 7 respectively provide front and side views of the flap 103 when incorporating a fluid trap end 106 to act as described previously as a further dampener upon forced fluid flow ejection. As illustrated in FIG. 5 the flap 103 includes pivot ears 104 which engage a hole in the housing 70 wall. In such circumstances as shown in FIG. 7 the flap 103 can move about the pivot ears 104 to displace the edge 105 and so alter the gap with a roller when associated with the flap. A means for causing flap displacement will be described later with regard to FIG. 8.

The flap 103 may also comprise a simple flat member with the edge 105 simply moved towards the roller in use to set the desired gap for operational efficiency. In such circumstances, some fluid may pass into the fluid trap behind the flap. It is also possible that the flap could be curved in order to replicate the shape of the housing adjacent to a roller.

It will be understood that one feature of the groove 160 is that as the groove 160 does not extend completely across the width of a roller. Fluid build up may be presented at each end edge of the groove 160. By arranging that the flap 103 extends beyond the width of the groove 160 is possible to spread these built up fluid beads onto the roller more effectively. It will also be understood that the groove 160 is set and limited by the width of the reservoir 14 used in the applicator (FIG. 1). In such circumstances if it is desired to use a wider roller in a housing there may be problems with respect to the necessity to use a smaller groove 160. The flap 103 will spread the fluid to the wider roller.

By use of a flap 103 in accordance with aspects of the present invention it is possible to spread the fluid presented through the groove 160 across the whole or wider width of roller.

Figure 8:
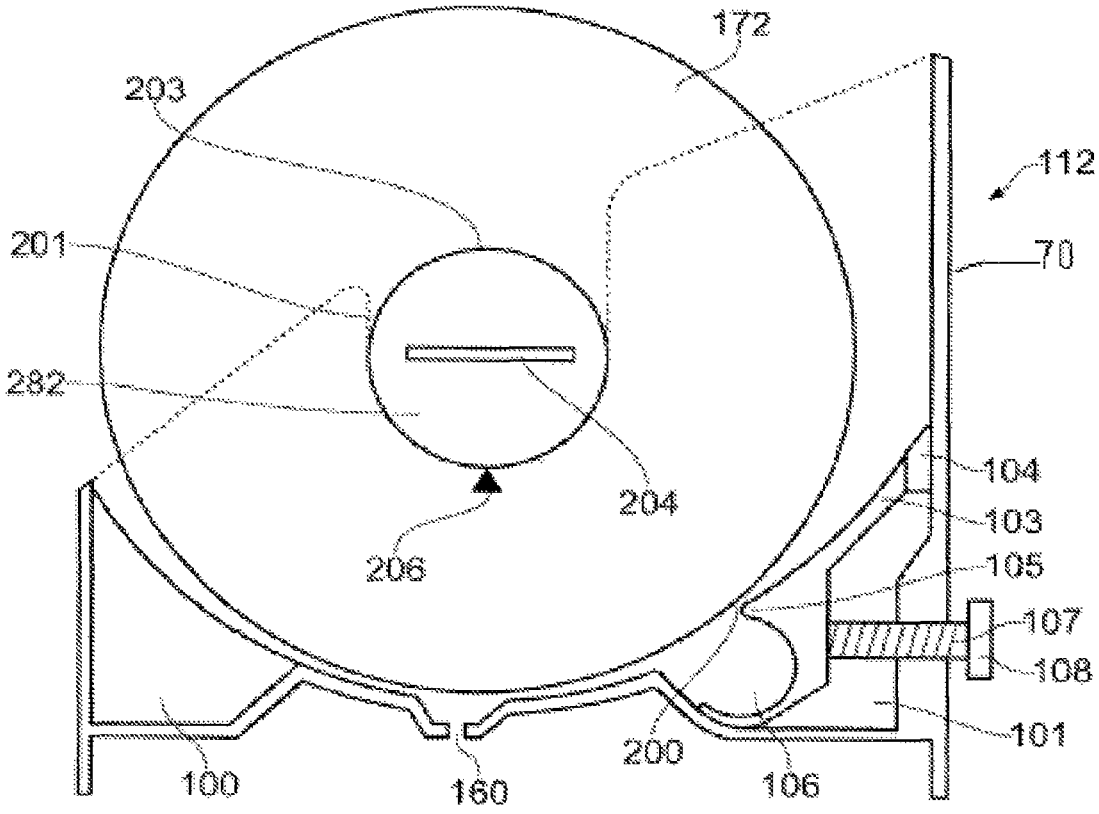
FIG. 8 is a cross section of a fluid applicator head incorporating the first aspect and the second aspect of the present invention.

It would be appreciated that a mechanism is required for achieving displacement of the flap 103 in order to present the edge 105 for adjusting the gap with a roller. FIG. 8 illustrates one approach to achieving this displacement. Thus, as previously a pivot end 104 is secured to the housing 70 in order to allow displacement of the flap towards a roller 172. This displacement is achieved through a screw thread 107 controlled by turning an adjustment end 108. In such circumstances it will be appreciated that the flap 103 moves towards the roller 172. The cavity 106 still provides a fluid trap to dampen excess fluid flow pressure and ensure good presentation of the edge 105 to the roller for distribution of fluid presented through a groove 160. The cavity 106 effectively acts as a damper upon forced fluid flow to again achieve regulation of that flow in association with the gap created between the edge 105 and the roller 172. To further dampen fluid pulsing an edge part of the trap may include a foam seal opposite the edge 105.

Although described as a pivot end 104 it will be appreciated that the flap 103 may simply be displaced by the screw thread 107. If so the end 104 simply acts as a seal against an opposed surface of the housing 70 to prevent fluid flow behind the flap which may become problematic.

The above first aspect of the invention allows adjustment of the gap between the end 105 and the roller 172 for particular fluid flow requirements in terms of viscosity and type as well as potentially wear on the roller and particularly the covering of that roller 172. It will also be understood that there may be reciprocal castellation in the roller 172 surface cover and the edge 105 which will create a striped spread of fluid upon a surface if required.

Although displacement is described through use of a screw thread 107 it will be appreciated that other displacement techniques may be used including ratchet positioning or an actuator rod for the flap 103. In either event positioning of the flap 103 may be regulated by marked movement of the screw thread or ratchet or otherwise to certain positions or combinations of roller 172, flap 103 and in particular edge 105 positioned in terms of fluid passing through the groove 160. Tables may be provided for best performance in terms of the gap 200 under certain conditions and with certain objectives for particular fluids.

A second aspect of the present invention is to more specifically and repeatedly set the offset cam by which the roller 172 is secured in the housing 70 for rotation. As indicated above this offset cam ensures that the roller 172 has an axis of rotation which is off centre from that of a slot 201 in which the roller 172 is secured. It will be understood that an end 282 upon which the roller 172 is secured in the housing 70 generally comprises a circular disc upon which a spindle mounting is positioned to receive a spindle for the roller 172. This spindle mounting is camming and positioned off centre from the circular centre of the end 282 so that by rotation of the end 282 the spindle position is moved and therefore the position at which the spindle rotates for the roller 172 is also displaced with an offset position. Generally, what is desired is accurate positioning of the end 282 to ensure that its spindle mounting and therefore the roller 172 is also accurately positioned. A particular gap 200 is achieved between the roller 172 and a part, in the particular depiction in FIG. 8 the edge 105 of the flap 103 and this may be adjusted by further rotation of the end 282. For the avoidance of doubt, where displacement of the flap 103 is not used then the roller 172 will then sit in the adjusted position with regard to the opposed part of the housing 70 for the fluid flow regulation.

In accordance with the second aspect of the present invention, the end 282 includes an orientation marker. This orientation marker may comprise a flat chamfered edge upon the end 282 or potentially a slot 204 in the end 282 normally used to accept a tool such as a flat head screwdriver to allow turning of the end 282. In either event, the orientation marker 203 and/or 204 allows the end 282 to be accurately orientated when inserted into the slot 201. It will be noted that the orientation marker 203, 204 is generally a flat or straight marker within the end 282 and this will be presented at a perpendicular angle to the slot 201 or other part of the housing upon insertion into the slot. By use of the orientation marker 203, 204 as indicated the end 282 is placed in the slot 201 with a degree of accuracy. Thus, as indicated above, the offset mountings for the spindle of the roller 172 are also accurately initially known or referenced to the externally visible orientation marker 203, 204. In such circumstances, upon turning of the end 282 the offset spindle mountings for the roller 172 have a camming displacing of the position of the axis of rotation for the roller 172 and therefore the position of the peripheral edge of that roller 172 in terms of its outer covering. This adjustment alters the gap 200 to that designed for fluid flow regulation.

Generally, the end 282 will be turned until there is association, such as alignment with an offset marker in the housing and generally adjacent to the slot 201. This offset marker may comprise a single arrow head or other mark 206 or a number of increments so that the marker 204 when aligned with the marker 206 shows the position of the spindle offset in a counting fashion for the axis of rotation of the roller 172. It will also be understood that the orientation marker 203 may be arranged to move to a parallel relationship with a similar marker or flat surface in the slot 201 to show correct offset position.

Figure 9:
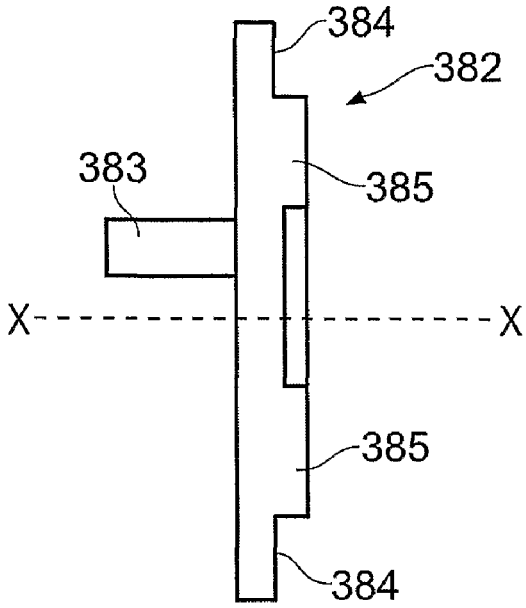
FIG. 9 is a side view of an end in accordance with the present invention.
Figure 10:
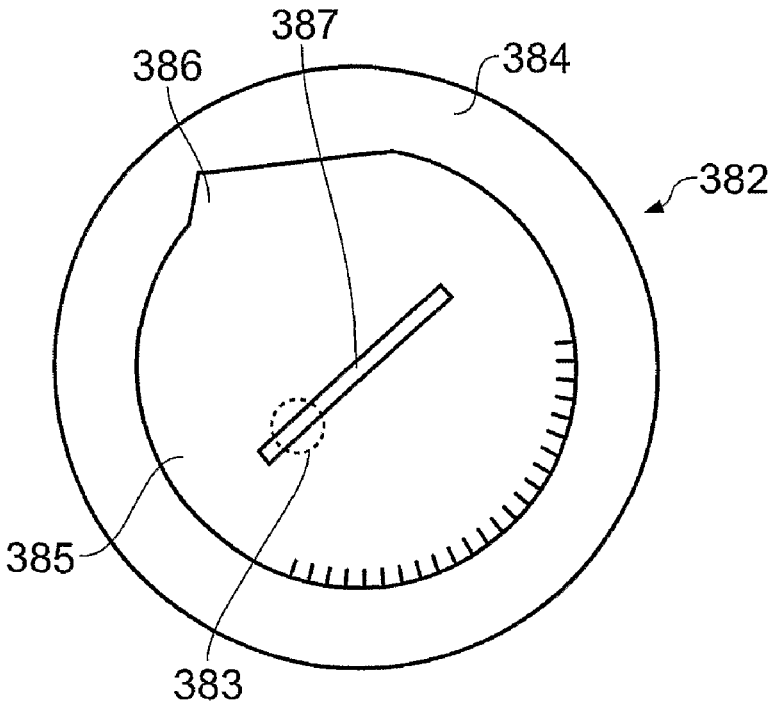
FIG. 10 is a front view of an end in accordance with the present invention.

FIGS. 9 and 10 respectively show in exaggerated fashion, the offset cam spindle mounting in accordance with the present invention. FIG. 9 shows a side view of an end 382 in accordance with the second aspect of the present invention. Thus, the end 382 includes a spindle 383 which is offset from the notional centre line X-X of the end 382. In such circumstances, the spindle 383 upon which a roller (not shown) will rotate will similarly be at an off centre position and the periphery of the roller as described above adjustable for fluid flow regulation. The end 382 as indicated, has an offset cam and an outer ledge engages an inner side of a housing slot through a shoulder 384 which ensures that a central portion 385 extends through the slot in the housing to allow rotation of the end 382 for offset cam positioning of the spindle 383. In such circumstances, when the end 382 is rotated, the spindle 383 is adjusted for offset positioning.

FIG. 10 illustrates a schematic view of the end 382 depicted in FIG. 9. Thus, the end 382 as indicated includes a shoulder 384 to engage a housing such that a central part 385 protrudes through the slot. The spindle mounting 383 (on the other side) is off centre and an orientation mark 387 which also acts as a slot for a turning tool is used to initially orientate the end 382. The offset of the spindle mounting 383 upon placing the end 382 in the slot is adjusted by rotation of the end 382. In such circumstances, as indicated previously by rotation of the end 382, the spindle 383 can be rotated such that there is an off centre axis of rotation for the roller in use.

It will be understood that if the central part 385 is completely circular then the end 382 can simply rotate completely within the slot. In order to prevent such rotation and therefore limit the range of rotation for the end 382 in a slot, a stop feature 386 is provided. This prevents over rotation or rotation in a clockwise direction away from the initial orientation defined by the orientation marker. It will be understood that the other end of the range of rotation may simply be created by the offset 383 being such that the roller mounted on the spindle is abutted by the housing to prevent further rotation of the end 382. In such circumstances, the range of possible off centre rotational axes for the roller is defined and by adjustment, it is possible to find a desired gap between the roller and the housing for fluid regulation.

Figure 11:
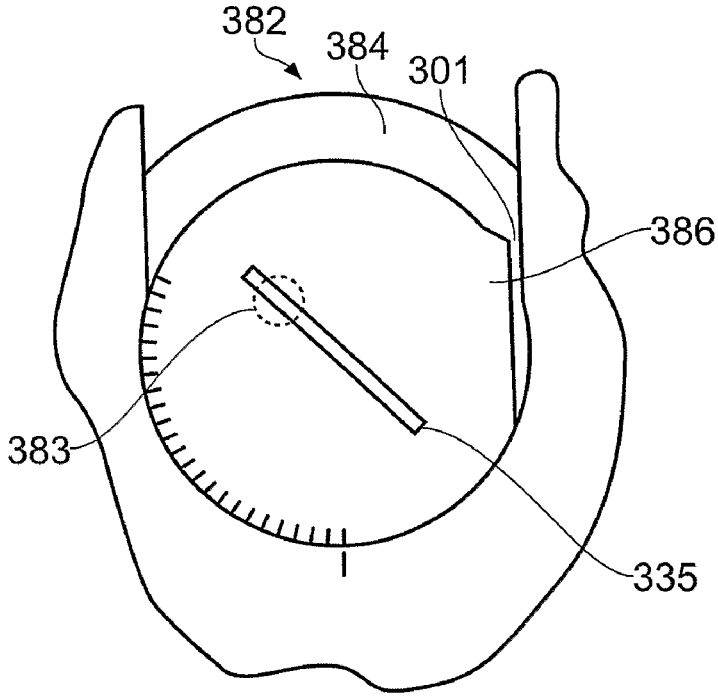
FIG. 11 is a front view of the end depicted in FIG. 10 at one end of its rotational range.
Figure 12:
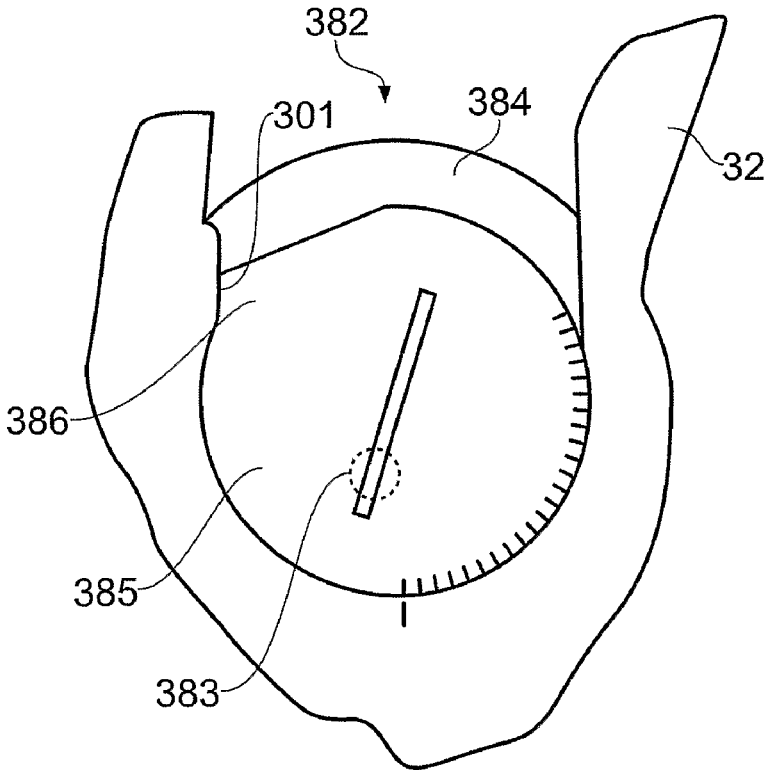
FIG. 12 is an end view of the end depicted in FIGS. 10 and 11 at the other end of its rotational range.

FIGS. 11 and 12 illustrate the rotational range for the end 382 in a slot 301. Thus, as previously, a central portion 385 of the end 382 is presented through the slot 301 and is allowed to rotate with a shoulder 384 acting against an inside surface of a housing in which the slot 301 is formed. As previously, a spindle mounting 383 is presented in a cam offset fashion such that rotation of the end 382 adjusts the offset position of the spindle mounting 383 for the roller and therefore the position of the roller relative to the housing surface as described above to define a gap for fluid regulation. In FIG. 11, a stop feature 386 in the central part 385 engages the slot to one side whilst in FIG. 12, the stop feature 386 engages the other side of the slot. In such circumstances, it can be seen that the spindle mounting 383 is displaced between the range defined by the stop feature 386 engaging with the slot 301.

Figure 13:
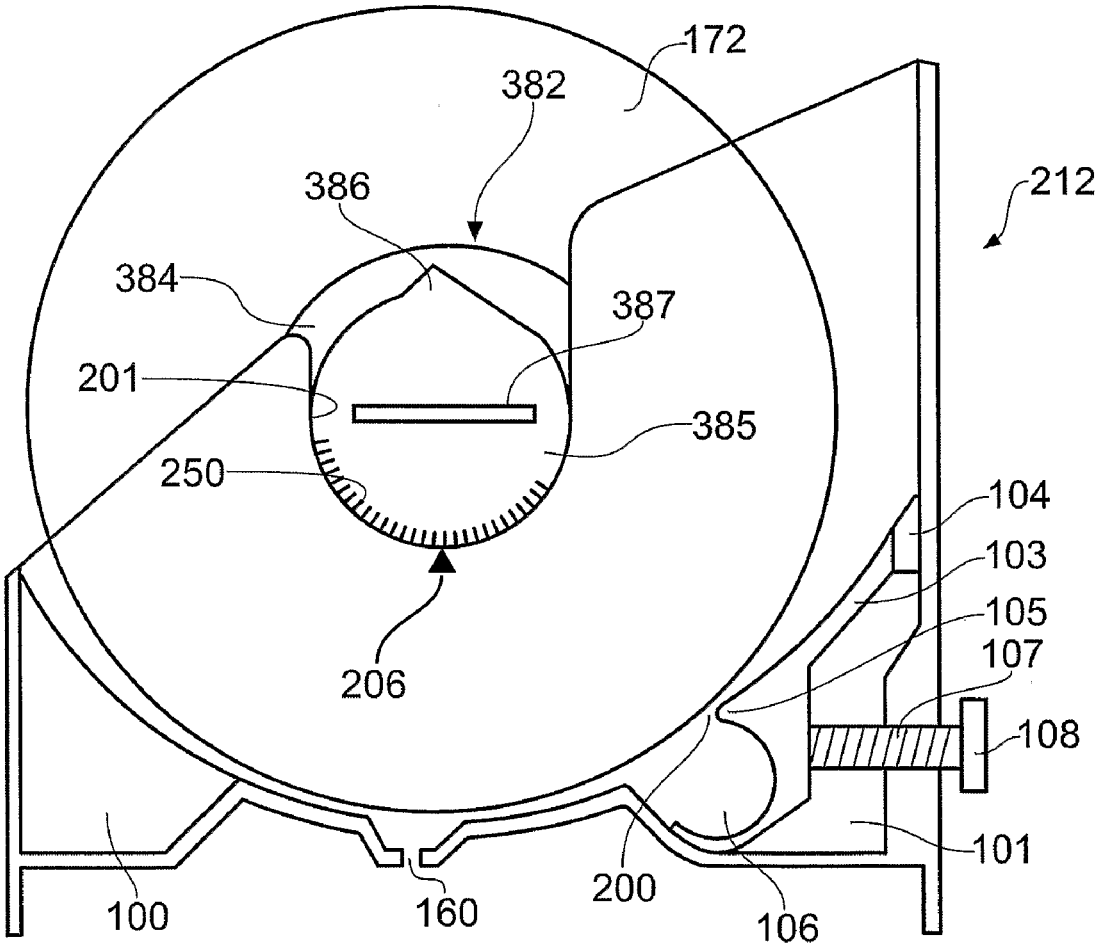
FIG. 13 is an end view of the end depicted in FIGS. 10 to 12 within a fluid applicator head.

FIG. 13 illustrates the end 382 secured in the same housing as described previously with regard to FIG. 8. Similar references have been used other than with regard to the end 382 for comparison. Thus, the roller 172 is secured upon a spindle which extends from the end 382 to the other side of the housing. The end 382 can rotate by inserting a tool into the slot 387. This slot 387 also acts as an orientation marker to provide an approximation for entry of the end 382 into the slot 201. It will be understood that offset markers 206 and 250 will be aligned on rotation of the end 382 to achieve the desired gap for the roller 172 relative to the edge 200.

As can be seen the stop feature 386 can also be utilised as an orientation marker for insertion of the end 382 into the slot 201. This stop 386 as indicated previously prevents rotation beyond a certain range by engagement with the slot 201.

As indicated above generally the end and in particularly the central portion 385 is designed so that there is a slight chamfer to one side to allow entry of the central part 385 into the slot 201 in the desired orientation. This chamfer or slot 387 or stop 286 may be utilized in order to approximate the correct entry orientation for the end 382. The central part 385 is desired to have a slightly larger diameter than the slot 201 so that upon rotation there is a progressive interference fit which ensures retention of the rotation in the desired orientation so retaining the gap between the roller 172 and the edge 200. As indicated previously this orientation is generally denoted through an alignment between the markings 206 and the markings 250.

As indicated generally a spindle is provided at both ends of the roller 172. These spindles may be connected by a bar which passes through the roller 172 with a pin and slot engagement to ensure matched rotation of the spindles when one is rotated.

Figure 14:
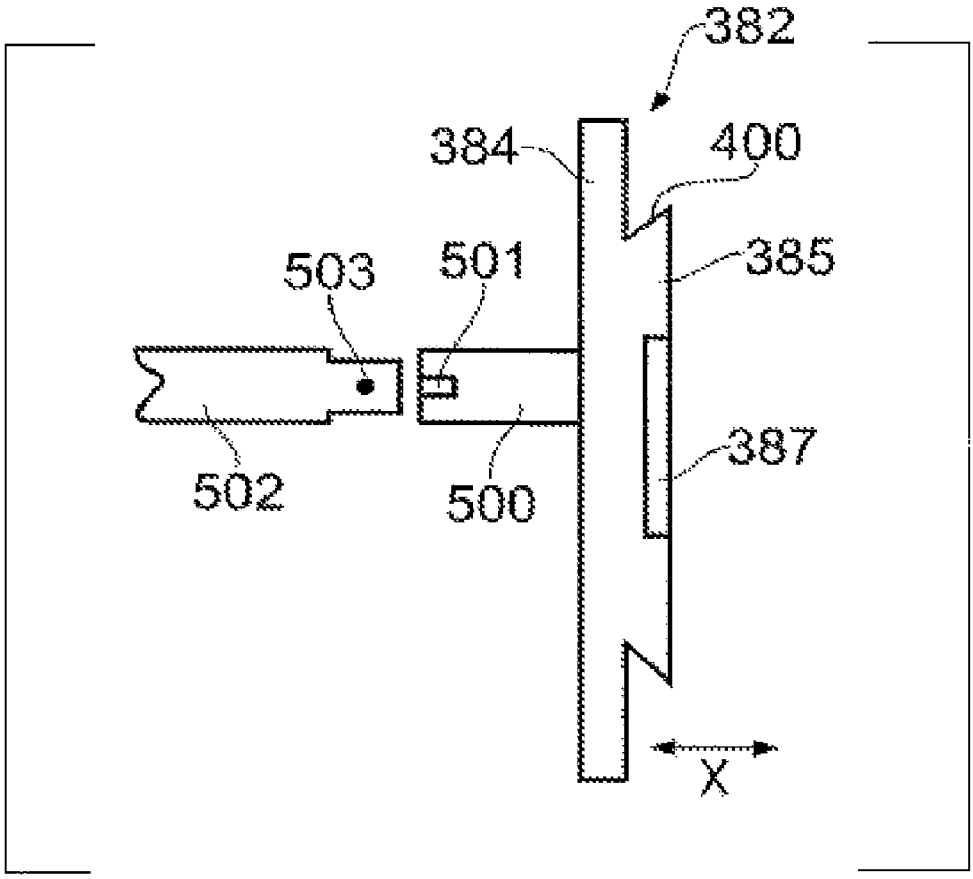
FIG. 14 is a side view illustrating an end including entrant features for maintaining end position in a slot and has means for association between spigots at each end of a fluid applicator.

It will be appreciated as the housing and applicator will generally be formed from a plastics material there is a potential for deflection of the housing walls incorporating the slot 201 under the pressures created by the interference fit. In order to avoid such problems the central part 385 may be keyed into the slot 201. This is achieved through an entrant association between the slot and a peripheral edge of the central part 385. FIG. 14 illustrates a cross section of an end with an entrant shape for association with a similar shaped slot. Thus, the end 382 has a central portion 385 with a dovetail recess 400 which will slot into a reciprocally shaped edge of the slot 201 depicted in FIG. 13. In such circumstances outward or inward pressure as a result of an interference association in the direction of arrowheads X will be resisted. It will be understood that entrant engagement between the central portion 385 and the slot 201 may take a number of forms including a tongue and groove as well as the dovetail shaping as depicted in FIG. 14. It will also be understood that the shoulder portions 384 will engage against the inner surface of the housing incorporating the slot 201 to further resist outward deflection of the end 382 as the interference fit is created by rotation to adjustment of the gap between the roller and the housing edge for best advantage.

Also illustrated in FIG. 14 is a means by which spindles at both ends of the housing can be arranged to be interconnected for reciprocal rotation. Thus, a spindle 500 secured to the end 382 includes a slot 501. A spindle bar or axle 502 from the other spindle at the end (not shown) of the roller includes a pin 503. This pin 503 enters the slot 501 when the ends are located in the slots of the housing so that through the pin 503 engaging the slot 501, coordinated rotation of the ends is achieved.

As illustrated above, with regard to the first and the second aspects of the present fluid applicator, it is possible to achieve regulation of the gap between the roller and the housing surface to that required by the particular fluid to be applied and under forced flow from the ratchet stepping mechanism created by the piston 18 in the reservoir 14 depicted in FIG. 1. This gap regulation can be achieved either through use of a flap in the housing or through control of the cam offset for the spindle mounting in the end or a combination of both aspects. Generally, in either event incremental marks will be provided in order to give an indication as to the gap achieved. It will be understood in the first aspect the housing in the form of the gap is moved whilst in the second aspect the roller is moved.

Figure 16:
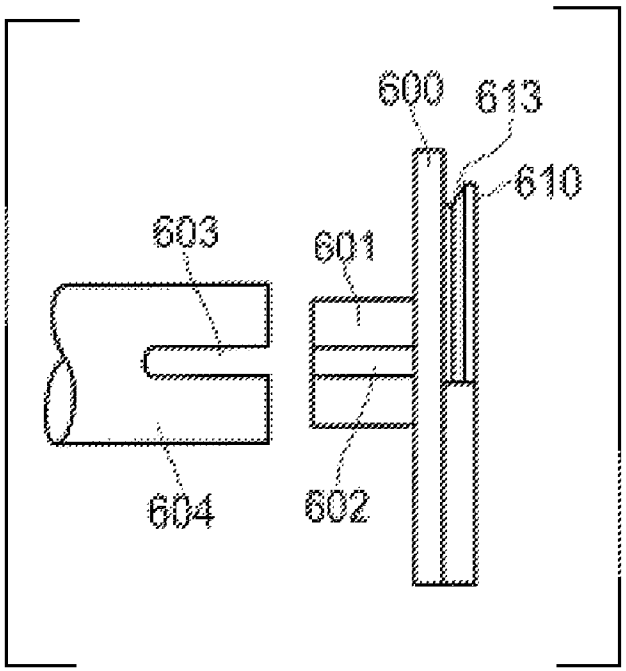
FIG. 16 is a schematic side view of a roller spindle secured to an end with an off-set cam in accordance with aspects of the present invention.
Figure 15:
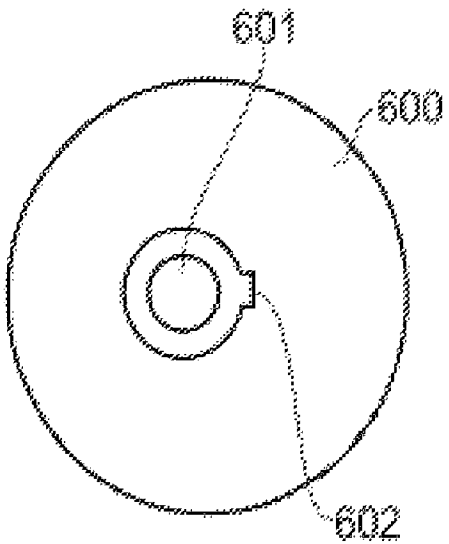
FIG. 15 is a schematic end seal of a roller incorporating a spindle with a stub bar in accordance with aspects of the present invention.

As indicated above, it is necessary to robustly secure a roller in accordance with aspects of the present invention with an end having an off-set cam in accordance with aspects of the present invention. FIGS. 15 and 16 illustrate an approach to achieving such robust association. In FIG. 15 an end incorporating an off-set cam is depicted incorporating a spindle spigot 601 having a stub bar 602. This stub bar as depicted in FIG. 16 engages with a slot 603 forming part of a spindle 604 associated with a roller (not shown). In such circumstances it will be appreciated that the stub bar 602 entering the slot 603 will therefore cause robust mechanical association and rotational carry between the end 600 and the spindle 604. The number of spindle bars and slots utilised will depend upon operational requirements but as illustrated a single spindle bar 601 and slot 603 may be used or spindle bars and slots in opposed or radially spaced positions may also be used.

Figure 17:
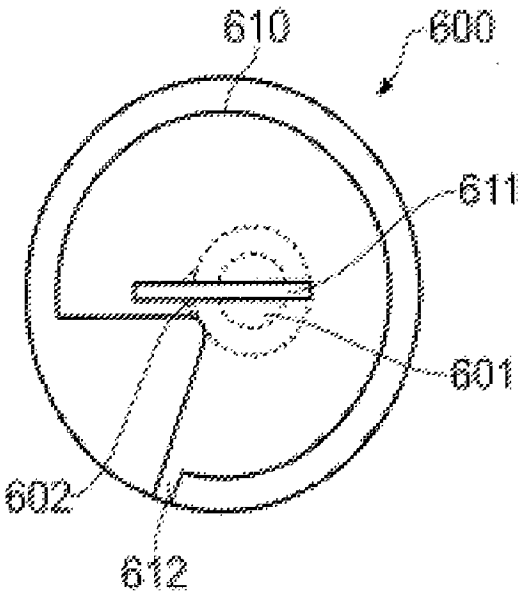
FIG. 17 is a schematic end view of an end incorporating an off-set cam in accordance with a third aspect of the present invention.

FIG. 17 illustrates the end 600 depicted in FIGS. 15 and 16 and incorporating an off-set cam in accordance with third aspects of the present invention. Thus, a cam off-set 610 is again provided to engage with an appropriate slot in a housing (not shown). Thus, as the off-set cam 610 is turned the position of the spindle upon which the roller is secured is moved. It will be appreciated that association between the spindle and end is accentuated for clarity in the figures. Such accentuated off-centring would create too great a displacement in reality for adjusting housing to roller gap. The end 600 incorporates a slot 611 to facilitate turning of the end and therefore the off-set cam 610 in the housing slot as described alter.

A third aspect of the present invention particularly depicted in FIG. 17 is provision of a stop end 612 which, as will be described later, acts as a limiter with respect to the range of rotation within the slot of the housing and therefore the range of gaps between the roller and housing is possible for appropriate fluid regulation in accordance with aspects of the present invention. This stop end 612 also at one end will through shaping of part of the housing slot facilitate removal of the off-set 610, from the slot.

It will be noted in FIG. 16 that the cam off-set 610 again incorporates grooves 613 which engage with parts of the slot in the housing to retain robust association between the end 600 and the housing in use over this displacement range as required.

Figure 19:
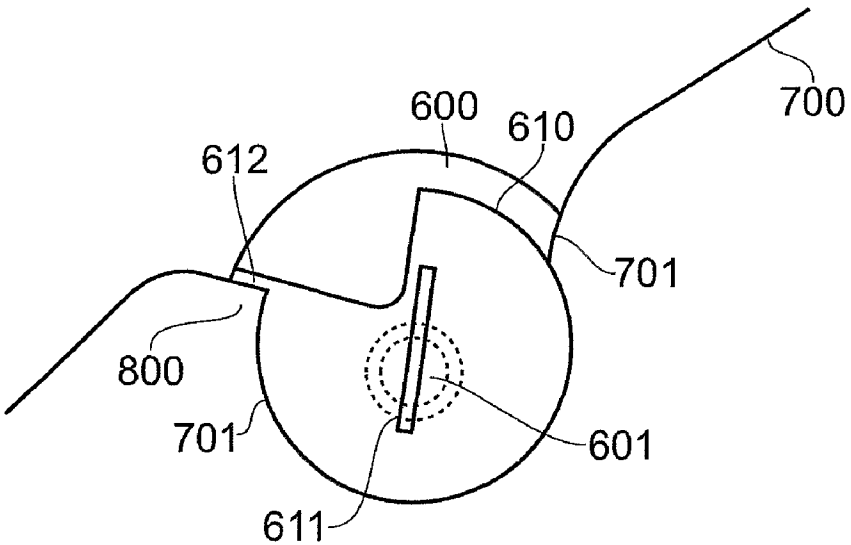
FIG. 19 is a schematic end view of an end incorporating an off-set cam in accordance with a third aspect of the present invention as depicted in FIGS. 17 and 18.

FIG. 19 illustrates the end 600 depicted in FIGS. 15 to 17 located in a housing 700 in part schematic cross-section. Thus, as previously, the end 600 incorporates an off-set cam 610 which engages a slot 701 of the housing 700.

A roller 702 is secured upon a spindle arrangement as described previously and rotation of the end 600 is achieved through a slot 611 and appropriate tool. The stop end 612 is depicted in a mid-way position for rotation of the end 600 in the slot 701. In such circumstances as depicted the roller 702 has a desired gap with an opposing part 703 of the housing 700 for appropriate fluid, that is to say paint, distribution presented through an aperture 704. In such circumstances the arrangement depicted in FIG. 18 operates in a similar fashion to described previously, that is to say utilising the off-set cam 610 in the slot 701 to create variation in a gap 705 between the roller 702 at the portion 703 of the housing 700.

Figure 18:
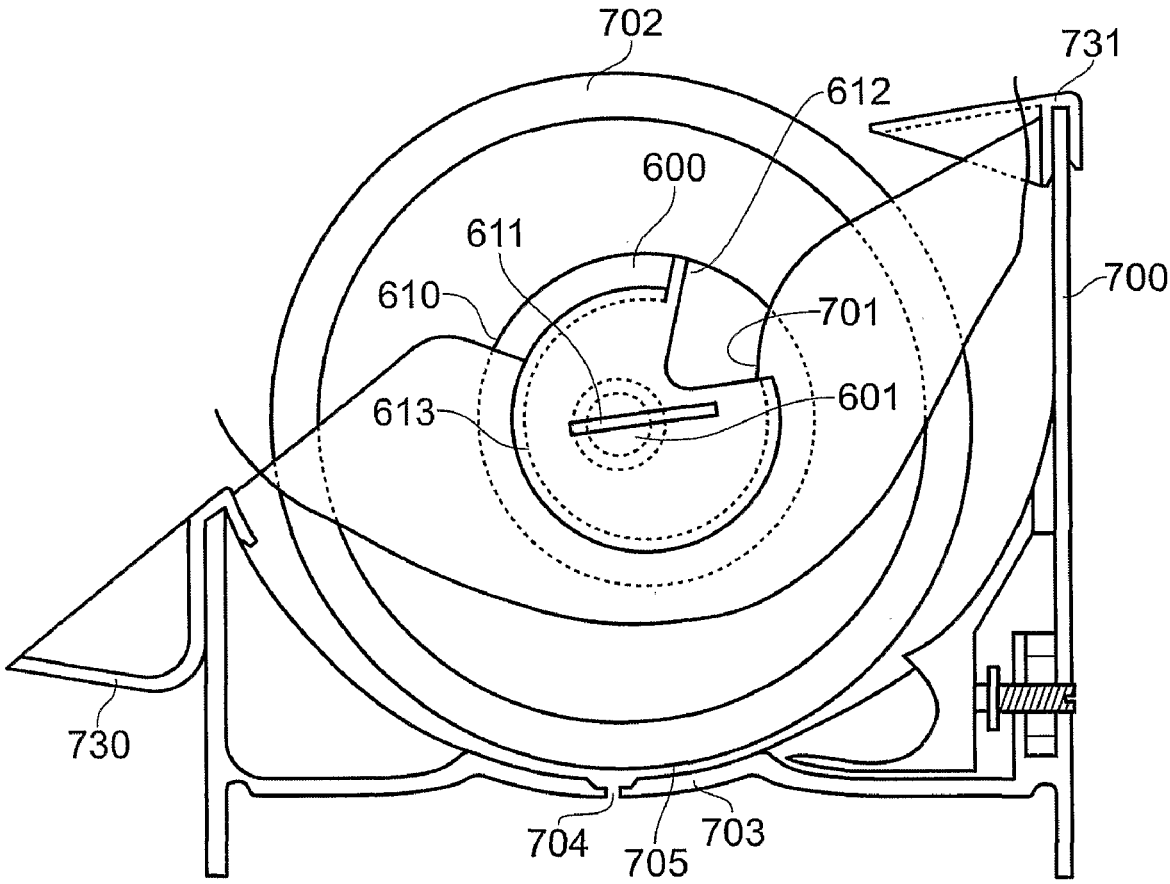
FIG. 18 is a schematic end view of an end incorporating an off-set cam in accordance with the third aspect of the present invention depicted in FIG. 17.

By use of the stop end 612 as indicated above the range of rotation of the end 600 in the slot 701 is defined which in turn defines the potential range of gap 705 values possible in accordance with the configuration depicted in FIG. 18. It will be appreciated that in such circumstances fine adjustment can be made by turning through the slot 611 to the desired gap 705 for a particular fluid viscosity or type. Also, different ends 600 may be provided having different off-set ranges and therefore variations in the gap 705 in use for different types of fluid etc. Retention of orientation of the offset cam and end 600 in the slot 701 is important to retainer gap 705 width for correct fluid flow on to a roller. This orientation retainer may be through on interference fit.

As can be seen in FIG. 18 the housing 700 may incorporate splash guards 730, 731 in order to limit splashing with regard to use of a fluid applicator in accordance with aspects of the present invention particularly in vertical, that is to say in situations where a ceiling is being painted with relatively viscous fluids. In such circumstances splattering and spotting of the fluid is possible so that guards 730, 731 will limit that splattering. As indicated above, the direction of roll of the roller 172 is important in order to create the correct gap 705. In such circumstances as can be seen, guard 731 will act to catch at least a proportion of any fluid spots thrown from the roller 702 whilst guard 730 will act to catch such thrown spots of fluid when the roller arrangement is in a vertical position.

As can be seen, the guards 730, 731 are typically secured by clip interference association with edge portions of the roller hood or housing 700 so that these guards can be easily removed when not required such as with respect to vertical walls rather than overhead ceilings.

Figure 20:
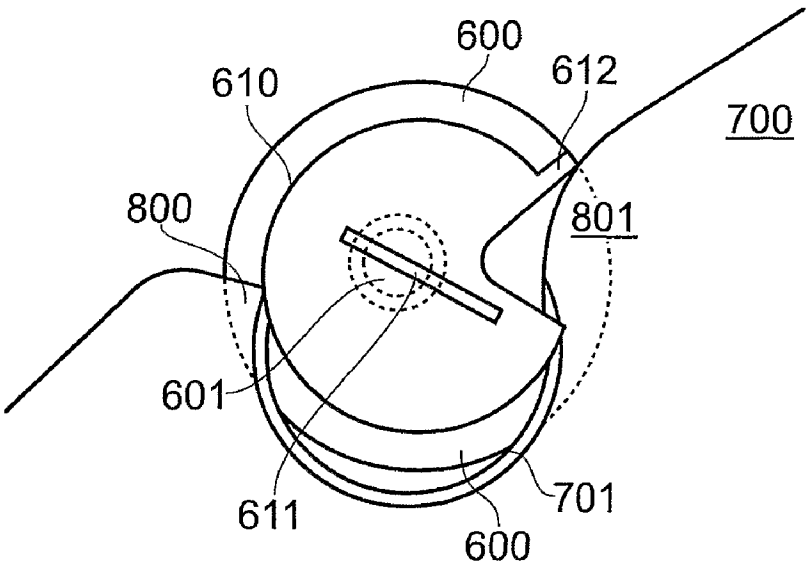
FIG. 20 is the end depicted in FIG. 19 upon withdrawal from a housing in accordance with aspects of the present invention.

FIGS. 19 and 20 illustrate a further advantageous feature of the end 600 having third aspects of the present invention. Thus, as depicted in FIG. 19 the end 600 is located through the off-set cam 610 in the slot 701 of the housing 700 at one extreme of a rotation range. The extreme is defined by engagement between the stop member 612 and a part 800 of the housing 700. As will be seen, there is an angular engagement between the part 800 and the stop member radial protrusion from the off-set cam 610 such that further attempt to rotation through use of the slot 611 and an appropriate tool will not allow further rotation but will ensure that the end 600 remains in association with the housing 700 within the slot 701.

FIG. 20 shows a configuration at the other extreme of rotation to that depicted in FIG. 19. Thus, the stop end 612 engages a rounded portion 801 of the housing 700 such that there is not an angular engagement and therefore continued rotation through turning in use of the slot 611 by an appropriate tool will cause the end 600 to lift out of the slot 701 to enable removal of a roller (not shown) from association with the housing 700. This will enable the roller to be cleaned, refurbished or replaced.

Between the extremes of rotation respectively depicted in FIG. 19 and FIG. 20 orientation will be retained normally by an interference fit.

Modifications and alterations to the embodiments of the aspects of the invention described above will be understandable by those skilled in the art. Thus, it will be appreciated that once the desired gap is achieved and a locking mechanism will be provided. This may be through an interlock preventing further rotation of the end upon which the roller is secure. Normally, only one end of the roller spindle arrangement will be adjustable with the other end simply a follower.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

The invention claimed is:

1. An applicator for fluids, the applicator comprising a roller within a housing with a gap between them, said applicator further comprising an end which includes a spindle, said spindle defining the axis of rotation for said roller, said spindle being offset from the notional centre line (X-X) of the end, said gap being defined by rotating said end and thereby offset cam positioning said spindle, said end being secured in a slot of the housing, the slot and the end having an entrant engagement, wherein the entrant engagement is a dovetail.

2. An applicator as claimed in claim 1 wherein the slot is arranged to accept a tool to cause rotation of the end.

3. An applicator as claimed in claim 1 wherein the housing has an offset mark to define offset cam positions.

4. An applicator as claimed in claim 1 wherein the housing incorporates a plurality of offset marks for different values of the gap.

5. An applicator as claimed in claim 1 wherein the end is chamfered to one side to allow the end to enter the slot and the end has a slightly larger diameter than the slot to cause an interference fit for retention of rotation.

6. An applicator as claimed in claim 1 wherein the end is integrally formed with the offset cam to define a mounting to accept the spindle.

7. An applicator as claimed in claim 1 wherein the applicator includes a stop member and the stop member engages a part of the housing in order to facilitate removal of the offset cam from the housing.

8. An applicator as claimed in claim 1 wherein a splash guard is provided upon at least one edge of the housing.

* * * * *